US006976735B1

(12) United States Patent
Bergin

(10) Patent No.: US 6,976,735 B1
(45) Date of Patent: Dec. 20, 2005

(54) ACCESSORY SUPPORT FOR CHAIR BACKS

(75) Inventor: Peter W. A. Bergin, Eden Prairie, MN (US)

(73) Assignee: Caddy Products, Inc., Minneapolis, MN (US)

( * ) Notice: Subject to any disclaimer, the term of this patent is extended or adjusted under 35 U.S.C. 154(b) by 0 days.

(21) Appl. No.: 10/648,699

(22) Filed: Aug. 26, 2003

(51) Int. Cl.[7] ..... A47C 7/62
(52) U.S. Cl. ..... 297/188.06; 297/188.2; 297/188.04; 211/88.01
(58) Field of Search ..... 297/248, 188.2, 297/163, 188.04, 188.06; 248/312.1, 295.11; 224/555; 211/88.01

(56) References Cited

U.S. PATENT DOCUMENTS 951,134 A * 3/1910 Knape ..... 248/250
2,807,315 A * 9/1957 Manne ..... 297/188.06
3,254,931 A * 6/1966 Jacobi ..... 297/188.07
4,767,131 A * 8/1988 Springer et al. ..... 280/304.1
5,421,638 A * 6/1995 Ayotte et al. ..... 297/188.04
5,628,103 A * 5/1997 Ayotte et al. ..... 29/525.01
5,709,429 A * 1/1998 Bergin ..... 297/188.04
5,713,628 A * 2/1998 Lucatuorto ..... 297/188.06
6,260,811 B1 * 7/2001 O'Neil ..... 248/311.2
6,457,772 B1 * 10/2002 Forston ..... 297/188.14
6,607,241 B2 * 8/2003 Johnston ..... 297/188.06

OTHER PUBLICATIONS

S & H Enterprises, LLC., *Wood Book Rack Communion Cup & Card Holder*, 2002.

* cited by examiner

*Primary Examiner*—Peter M. Cuomo
*Assistant Examiner*—Stephen D'Adamo
(74) *Attorney, Agent, or Firm*—Westman, Champlin & Kelly

(57) ABSTRACT

An accessory support or holder is provided with pockets for holding items such as hymnals, communion cups, pencils and memo pads, and is adapted to be supported on a chair support standing between chair backs with the chairs joined in a row. The accessory support or holder has a vertical wall that fits between the chair backs of adjacent chairs and is securable to brackets on the chair backs and a bracket on a chair standard that are normally used for securing the chairs together and supporting the chair. The accessory support has members that will engage the chair backs and hold the accessory support oriented properly for use.

8 Claims, 5 Drawing Sheets

ACCESSORY SUPPORT FOR CHAIR BACKS

BACKGROUND OF THE INVENTION

The present invention relates to a holder or support for books, pads, pencils, pens and other accessories at the backs of chairs, that attaches to brackets holding pairs of chairs together. The holder is positioned at the back of a each pair of chairs in a row of chairs attached side by side, particularly for seminars, meetings and religious services. The holder or support can be molded easily and has an attachment member that extends between existing chair brackets and is bolted to be held securely in a usable position.

It has long been known that the backs of pews used in houses of worship have had hymnal holders attached to the backs. At the present time, padded chairs that have individual backs for comfort, are bolted side by side in rows in many gathering places and sanctuaries. The chairs will sometimes have wire racks or other clip on racks to support hymnals, attendance cards, memo pads and the like, but these are generally not adequately secured and tend to slip around in use and sometimes fall off.

Thus, the need for attractive, sturdily mounted, and adequately sized supports or holders for books and the like exists.

SUMMARY OF THE INVENTION

The present invention relates to a support or holder that has receptacles for receiving books such as hymnals, and other items or accessories commonly used in houses of worship or community gathering places. The support or holder fixedly mounts onto chair brackets of two adjoining chairs using existing brackets that hold a pair of chairs together. The holder is supported against the chair backs with rest portions that will orient the holder so that the top is generally horizontal, even with a rearwardly inclined chair back.

The accessory supports or holders of the present invention have a vertical bracket wall or panel that is generally perpendicular to the laterally extending (or transverse), vertical central plane of the holder. The bracket wall or panel projects from the holder and extends between a pair of adjacent chairs with the holder at the rear of the chairs. The vertical bracket wall or panel can be attached between existing chair brackets that are used for securing two chairs together, using the same fastener openings on the chair brackets as used for holding the chairs together, with slightly longer bolts or screws. The vertical bracket wall or panel permits adjustment of the mounting angle of the holder to fit the existing chair back construction and securely retains the accessory holder or support in position. The holes for attaching the bracket wall can be made for mating with specific chair models or can be custom fit upon installation.

The accessory holders are easily molded from a plastic material, if desired, or other suitable molded material so that they are smooth, easily made, and can be decorated in various colors, or embossed with medallions, symbols or icons during the molding process.

Additionally, the back or rear wall of the holder, which faces the user seated behind the chairs on which the holder is supported, is substantially planar.

The holder has wide use in auditoriums and other places where events are held that require, or are assisted by, song books, memo or attendance pads, pens, pencils and the like.

DESCRIPTION OF PREFERRED EMBODIMENTS

Figure 1:
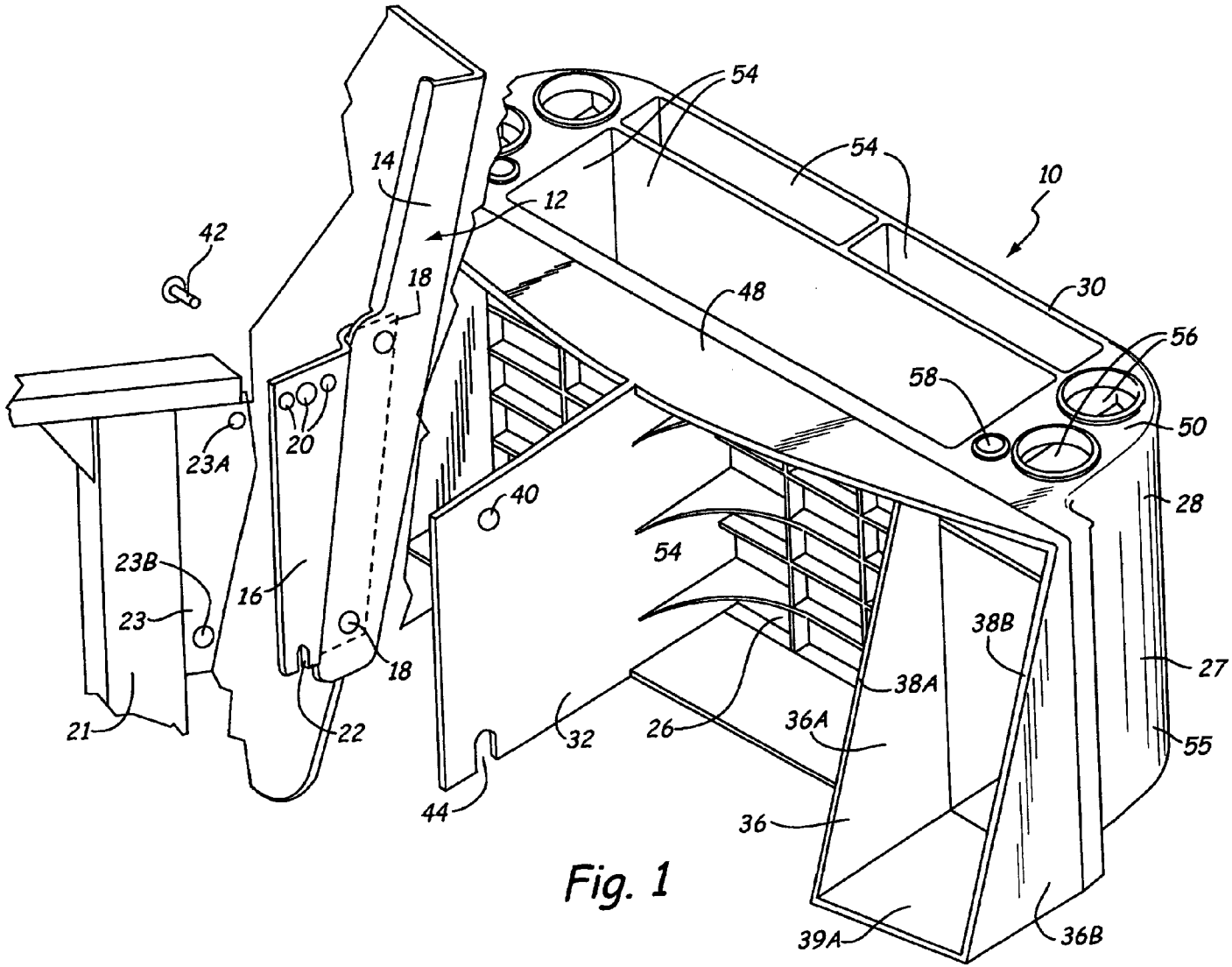
FIG. 1 is a fragmentary perspective view showing a chair back and an accessory holder made according to the present invention in an exploded view.

Referring first to FIG. 1, a holder or support 10 made according to the present invention is shown in position adjacent a single chair back 12, of conventional design. The holder is shown against two chair backs 12 in FIG. 2. As shown, the chair backs 12 are inclined rearwardly in upward direction, and can have a cushion 15, (FIG. 2) if desired. Each chair back 12 has a side flange 14 along each of the sides of the chair back. A chair attachment bracket 16 is bolted or riveted with fasteners 18 to the flanges 14 of each chair back. The brackets 16 extend forwardly from the flanges. The attachment brackets 16 have offset sections so the forwardly extending portions are flush with the outer side surfaces of flanges 14 and can be secured to form a row of joined chairs.

The brackets 16 are provided with one or more top holes 20 adjacent the top edge thereof, which can be used for adjustment of the chair back angle, and the brackets 16 have a downwardly opening slot 22 at the bottom.

These holes 20 and the slot 22 are used for fasteners for securing the two adjacent chair backs to a chair support standard 21. In the form shown, the chair support standard 21 is a floor mounted standard, but standards that attach to the risers of bleachers also can be used, as well as other types of standards.

The standard 21 has a vertical mounting panel wall 23 that extends rearwardly and has openings 23A and 23B that will align with openings 20 and slot 22 on the chair back attachment brackets 16. The standard 21 also has chair seat support brackets 24 (FIG. 2) on which chair seats can be attached.

The accessory support or holder 10 of the present invention as shown, has a main housing section 25 provided with a front wall 26 (as viewed by a user behind the row of seats supporting the holders 10), as well as end walls 28, and a rear wall 30, facing the user. The front wall 26, as shown, is adjacent to the chair backs 12 and has a vertical bracket wall or panel 32 secured thereto and is suitably braced to the front wall 26 with braces 34. The front wall 26 also can have strengthening webs, as shown, for additional deflection resistance if desired.

At opposite ends of main housing sections 25 of the accessory holder 10, there are ears 27 that extend laterally outwardly from the end walls 28 and are the same vertical height as the housing. A pair of chair back supports 36 are provided on the front wall 26 adjacent the ends of the wall 26, at the front sides of ears 27. These supports 36, as shown, are wedge shaped and have side walls 36A and 36B which are spaced apart and form a stable support with the edges 38A and 38B resting against the rear surface of a supporting chair back 12. The edges 38A and 38B engage the chairs back when the vertical bracket wall or panel 32 has been secured in place on a chair support standard 21, and between the attachment brackets of two chair backs.

As shown in FIG. 1, the bracket wall or panel 32 of the holder 10 has an opening 40 that is made to align with the opening 23A on the chair standard mounting panel 23, and with one of the openings 20 in the chair back brackets 16. The opening 23B on the associated standard mounting panel 23 aligns with a downwardly opening slot 44 in the bracket wall or panel 32 and with slot 22 on the chair back brackets 16. The holes or openings on the bracket wall 32 of the holder can be placed at any location to match the openings on the chair brackets and standard.

Figure 2:
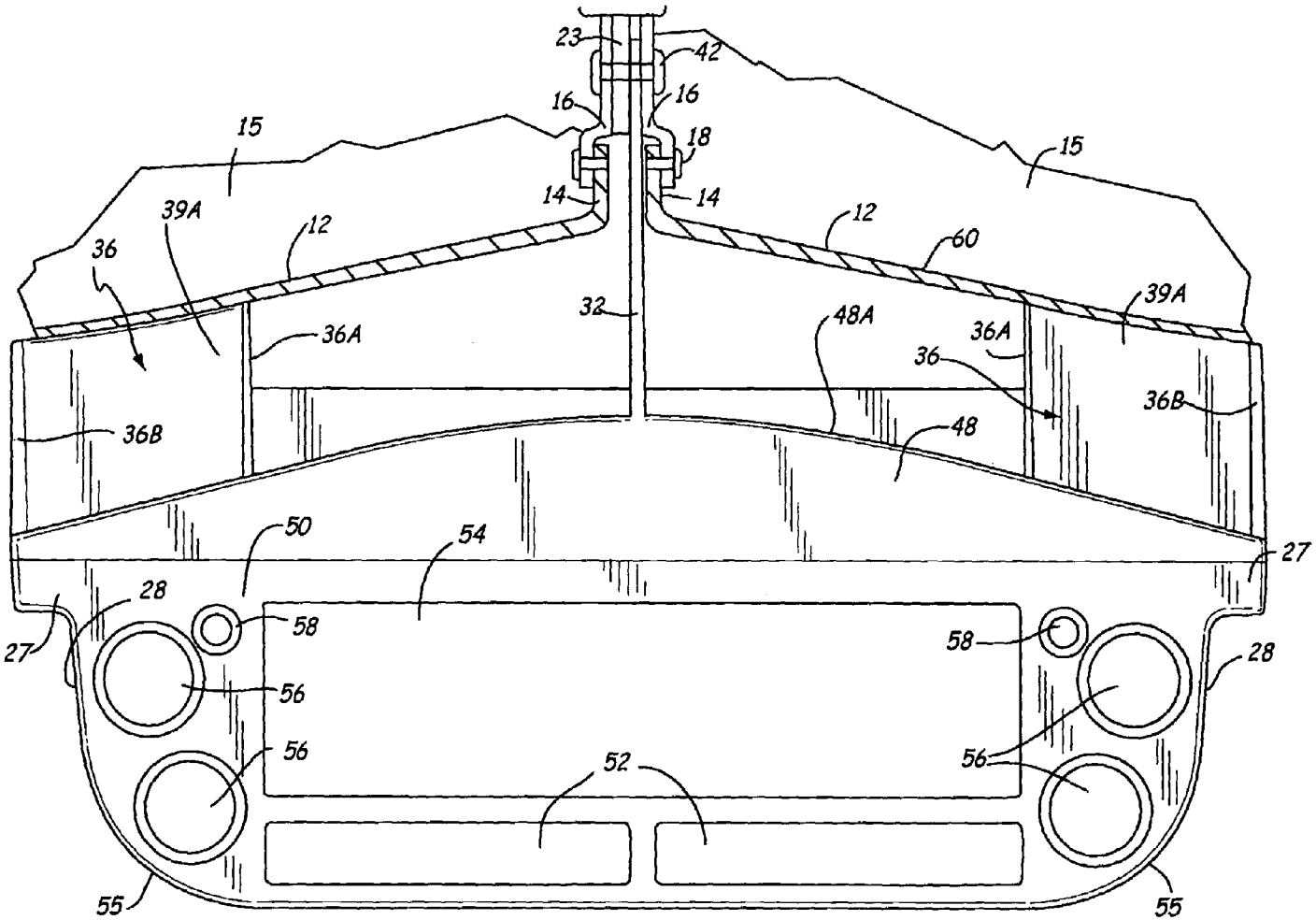
FIG. 2 is a fragmentary top sectional view of the holder made according to the present invention shown installed between a pair of chairs.
Figure 3:
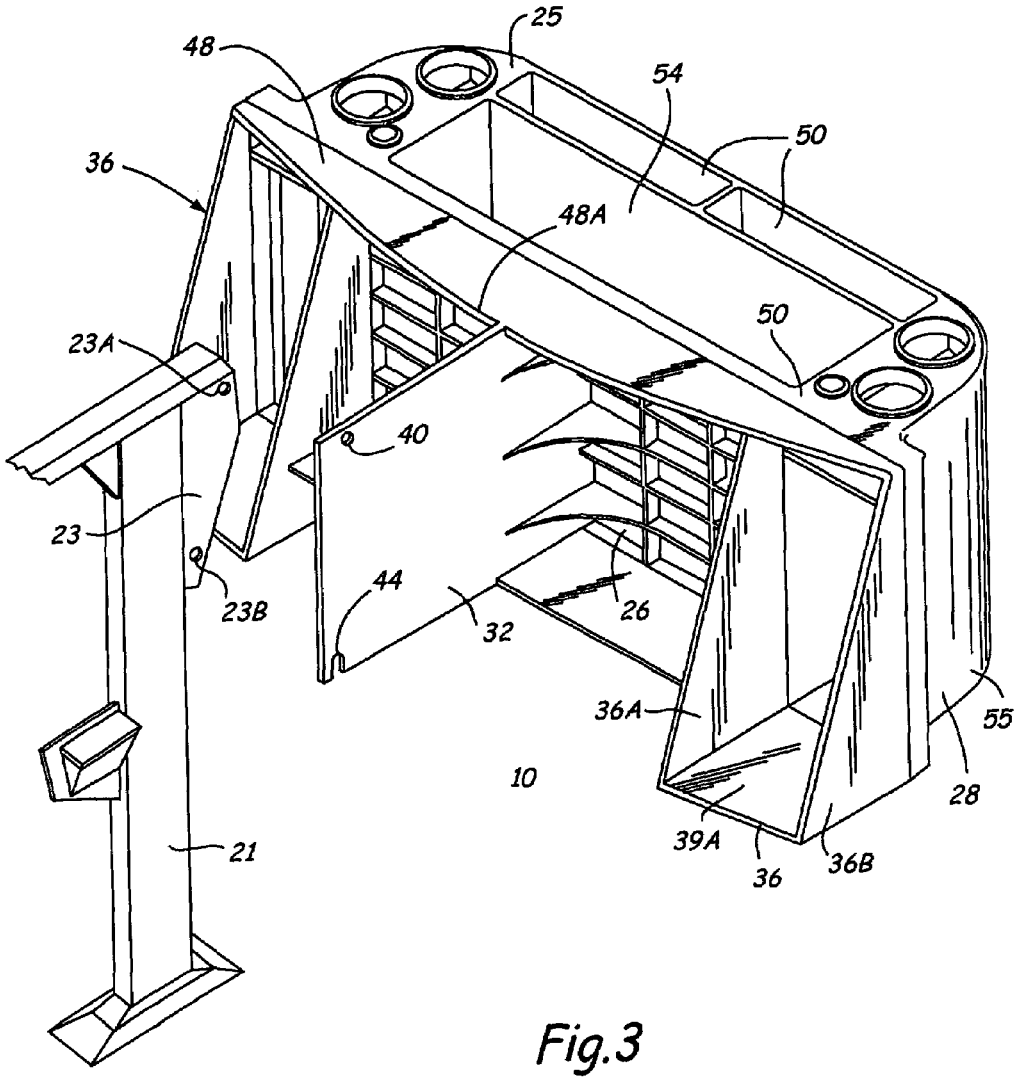
FIG. 3 is a rear perspective view similar to FIG. 1 with the chair backs removed, and a chair seat support standard shown.

The main housing section of the holder 25 has a top wall 50. A flange 48 is integral with the top wall 50 and extends toward the chair backs, and has an edge 48A that is curved as shown in FIGS. 1 and 2. The edge 48A will have other desired shapes to match the curvature of the chair backs 12 that generally are convex in the center portion of the back, which makes the junction region of two adjacent chair backs concave. The contour of edge 48A will change to match the contour of the chair backs. The edge 48A does not have to be convex, but can be concave in parts, and it does not have to be a continuous.

The main housing section 25 may include receptacles or pockets for memo pads or small books in the top wall 50 such as that shown at 52, as well as a large receptacle or pocket 54 made of suitable walls, of size for holding hymnals or books. Optionally, communion cup receptacles 56 can be provided along the edges of the top wall 50 spaced from the receptacle 54 for the hymnals. The number and position of the communion cup holders can be selected from zero to as many as needed. Additionally, receptacles 58 for pens or pencils can by provided on the top wall 50 so that the accessories held by the accessory support 10 can be any selected type.

The main housing section 25 has rounded end corner walls 55, when viewed in a horizontal plane along the top wall 50. The rounded corner walls 55 join the rear wall 30 and end walls 28. A curved wall also blends the end walls 28 and ears 27 together.

The ears 27 can be provided with openings for screws that can be used to stabilize the ends of the holder on the chair backs.

When the accessory support or holder 10 is to be installed and the chairs are joined together, or to be joined together, the chair backs are separated so that the brackets 16 are released or spaced from the support panel 23 on the standard 21, and the bracket wall or panel 32 of the holder 10 is slipped between one of the brackets 16 on one of the chair backs, and the support panel 23. Then, suitable fasteners, such as those shown at 42, which are similar to the fasteners or bolts used for mounting the chair backs to the support panel or wall 23 of the standard, but longer, are used for passing through the provided openings in the brackets 16, and in aligning openings in the vertical bracket wall or panel 32 on the support or holder 10, and the support panel 23. These walls or panels are secured in place together, and the accessory support 10 is then held securely in place. The end supports 36 will rest against the outer surfaces of the chair backs.

Figure 4:
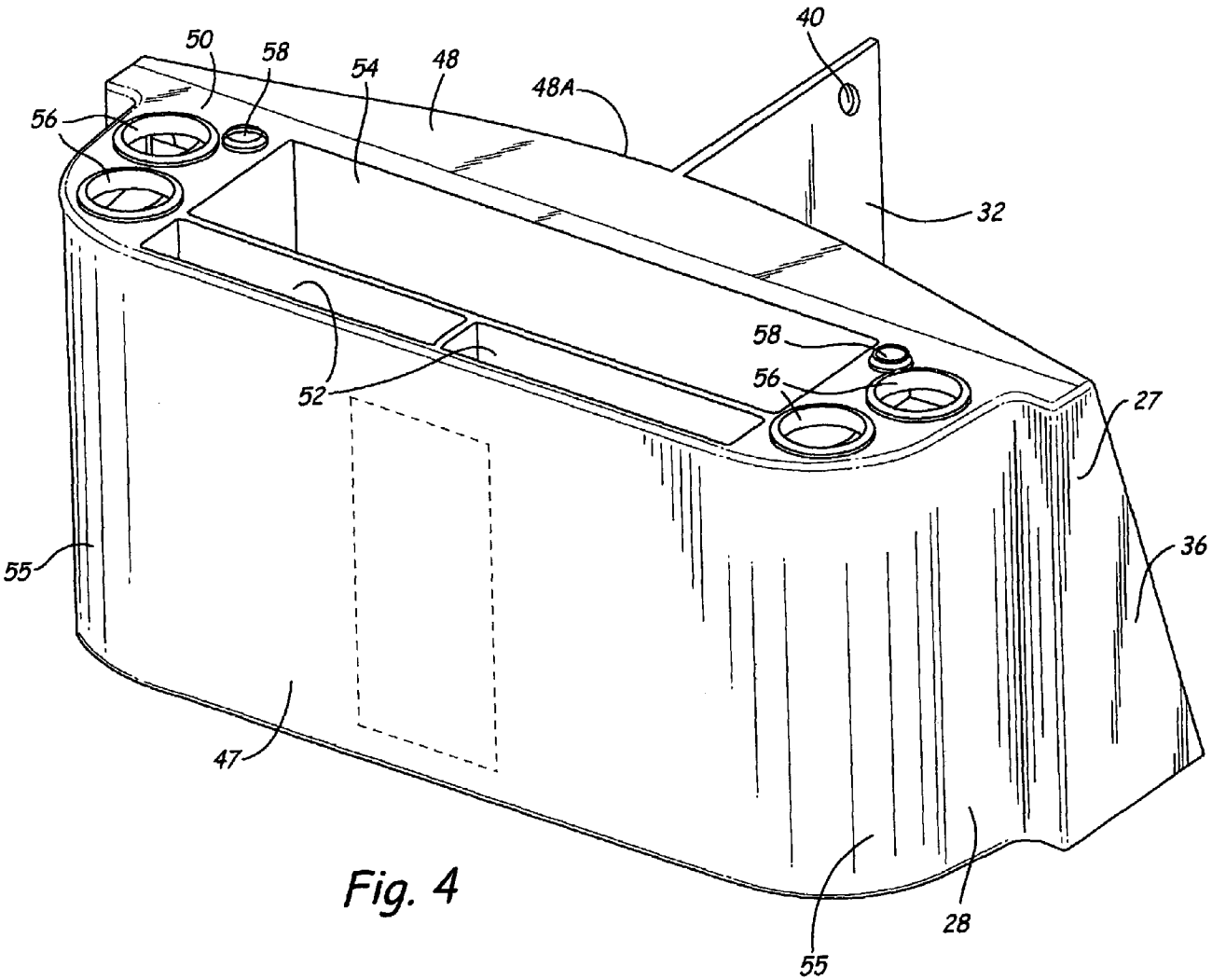
FIG. 4 is a front perspective view of a holder made according to the present invention.
Figure 5:
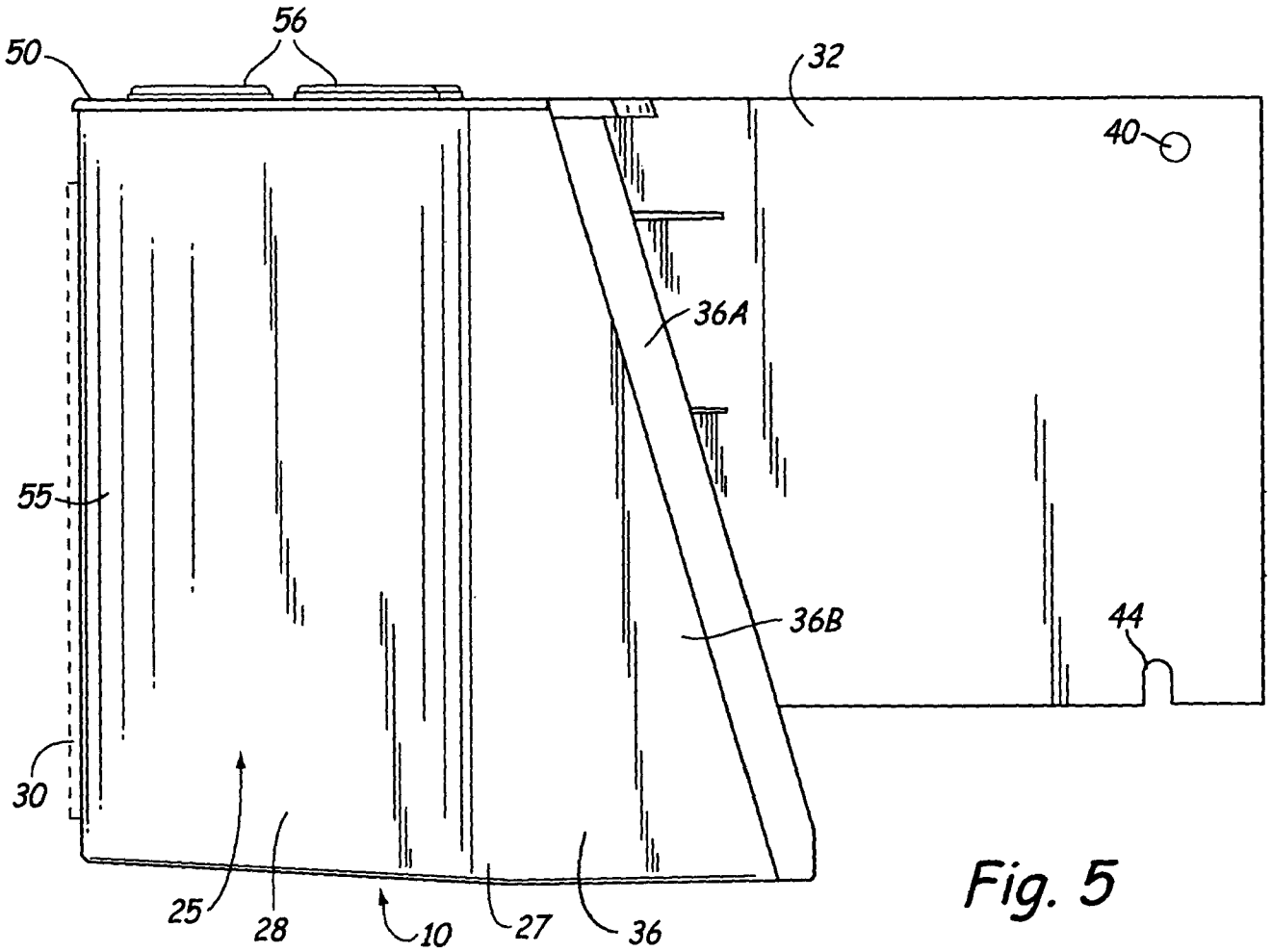
FIG. 5 is an end view of the accessory holder taken looking toward the right end in FIG. 2.

Again, it is pointed out that the type of accessory holder or support illustrated herein is adapted especially for use in houses of worship where hymnals and other similar items or accessories are desired to be held. The wall 30 has space outlined in dotted lines in FIG. 4 where an insert in the mold can be placed to mold in a medallion.

The inclined edges 38A and 38B on the supports 36 are formed to mate with the incline of the chair backs used. It can be seen in FIG. 2 that the outer side walls 36B do not extend out from wall 26 as far as the inner side walls 36A, and that the lower cross wall 39A on each of the supports 36 is shown engaging the chair back illustrated separately at 60 in FIG. 2. The sectional view of FIG. 2 shows the lower portion of the chair back at the level of lower cross wall 39A. The edge 48A of the flange 48 also will fit against the chair backs at the vertical position of the flange 48, since the chair backs incline rearwardly. In FIG. 2, the cross section of the chair back is taken at a lower level so the edge 48A appears to be spaced from the chair back, but edge 48A will engage the chair back at the level of the flange 48. Again, the configuration of edge 48A can be modified as wanted.

The accessory holder is thus utilitarian, and yet can be molded so that it has smooth contours and makes an attractive accessory holder or support for auditoriums, sanctuaries, or large rooms that use song books, hymnals or similar items, as well as memo pads and pencils. Various receptacles can be provided as desired.

Also, the bracket wall 32 can be configured differently. A double wall can be used and forwardly projecting straps can be added. Secure attachment to the chair backs is desired.

Although the present invention has been described with reference to preferred embodiments, workers skilled in the art will recognize that changes may be made in form and detail without departing from the spirit and scope of the invention.

What is claimed is:

1. A holder for books, pads, pens, pencils attachable at the backs of a pair of side-by-side chairs having side brackets for attachment to a standard having a support wall, the holder having a housing and a substantially vertical, flat planar bracket wall extending outwardly from the housing for placement between and securing to the brackets of one of the chair backs and the support wall of a standard, the housing extending laterally of the bracket wall to engage the surfaces of two adjacent chair backs when the bracket wall is positioned on the support wall, the holder further characterized by a pair of end supports on two opposite, lateral ends of the holder comprising a separate end support member at each of the two opposite, lateral ends of the holder, the end support members having generally vertical walls that are inclined from a maximum width adjacent a lower edge of the holder to a minimum width adjacent a top of the holder.

2. A holder for books, pads, pens, pencils attachable at a pair of chair backs of side-by-side chairs having side brackets for attachment to a standard having a support wall, the holder having a housing and a substantially vertical, flat planar bracket wall extending outwardly from the housing for placement between and securing to the brackets of one of the chair backs and the support wall of a standard, the housing extending laterally of the bracket wall to engage the two chair backs when the bracket wall is positioned on the support wall, the holder further comprising a plurality of end supports protruding from the housing, each of said end supports comprising at least two generally vertical engagement surfaces and at least one generally horizontal engagement surface adjoining the vertical engagement surfaces, whereby each of said generally vertical and generally horizontal engagement surfaces is configured to engage the chair backs.

3. The holder of claim 2, further comprising a generally horizontal flange on the holder at an upper side thereof and having an edge contoured to abut said chair backs, along a generally horizontal, extended portion of a concave recess formed by adjacent chair backs, said generally horizontal flange comprising said generally horizontal engagement surfaces of said end supports.

4. An accessory support for positioning at the backs of a pair of side-by-side chairs, such chairs having chair backs and chair back brackets along sides of the chair backs that are attached to a standard when the chairs are side-by-side, the accessory support comprising a housing having receptacles for receiving accessories, and a substantially vertical, flat planar bracket wall extending substantially perpendicularly from the housing for placement between a pair of the chair backs for securing to the chair back brackets; wherein there are end supports protruding from the accessory support housing to engage surfaces of the chair backs along adjoining generally horizontal engagement surfaces and generally vertical engagement surfaces, wherein the generally vertical engagement surfaces have a height substantially similar to a height of the accessory support, the end supports being spaced laterally from and on opposite sides of the vertical bracket wall; and wherein said end supports for engaging the surfaces of the chair backs comprise a separate end support member at each end of the accessory support housing, said generally vertical engagement surfaces being inclined toward the accessory support from a bottom plane to engage the chair backs that are inclined rearwardly and upwardly while maintaining an upper surface of the accessory support generally horizontal, each of said end support members having at least two of said vertical engagement surfaces.

5. The accessory support of claim 4, further comprising a flange on the accessory support housing at an upper side extending toward the chair backs and having an edge contoured to conform to contours of the chair backs when mounted on the chair backs.

6. The accessory support of claim 4, wherein said accessory support housing has receptacles of size to receive books, memo pads, pencils or communion cups.

7. The accessory support of claim 4, the bracket wall comprising a bolt hole configured to receive a bolt secured through a corresponding bolt hole of the chair back bracket, the bracket wall further comprising a bolt slot, spaced apart from the bolt hole, the bolt slot configured to receive a second bolt secured through a corresponding bolt slot of the chair back bracket.

8. The accessory support of claim 4, wherein said accessory support housing comprises a main section protruding outwardly from the chair backs on which the accessory support housing is mounted, a wall on the side of the main section spaced from the chair backs, and ends having rounded corner walls joining end walls of the main section, and ears protruding from the end walls of the main section to define the outer lateral side edges of the main section.

* * * * *